United States Patent [19]

Cox

[11] Patent Number: 4,602,576

[45] Date of Patent: Jul. 29, 1986

[54] TUFTING MACHINE HOOK

[76] Inventor: Ronnie L. Cox, Rte. 5, Box, 89, Old Newton Rd., LaGrange, Ga. 30240

[21] Appl. No.: 796,192

[22] Filed: Nov. 8, 1985

[51] Int. Cl.[4] ..... D05C 15/00

[52] U.S. Cl. ..... 112/80.55

[58] Field of Search ..... 112/79 R, 79 A

[56] References Cited

U.S. PATENT DOCUMENTS

| | | | |
|---|---|---|---|
| 4,155,318 | 5/1979 | Yamamoto | 112/79 R |
| 4,397,249 | 8/1983 | Slattery | 112/79 R |
| 4,557,209 | 12/1985 | Watkins | 112/79 R |

*Primary Examiner*—Ronald Feldbaum

*Attorney, Agent, or Firm*—Alan Ruderman

[57] ABSTRACT

A hook for a tufting machine has an inclined ramp ground on the shank of the hook adjacent the throat. The ramp acts as a cam surface as a knife oscillates into and out of cutting engagement with the cutting edge of the blade of the hook. The cam surface permits the tension between the knife and the hook to be increased substantially relative to the prior art by preventing "heeling" of the knife against the hook when the tension is increased. As the knife slides up the ramp the tension between the knife and the hook actually increases. An additional incline is further disclosed along the ledger portion of the hook adjacent the throat and is sloped so as to provide the ledger portion of the hook equally between the surfaces of the hook so as to prevent "J" cutting as the knife cuts loops in conjunction with the ledger blade.

8 Claims, 6 Drawing Figures

TUFTING MACHINE HOOK

BACKGROUND OF THE INVENTION

This invention relates to tufting machine hooks and more particularly to such hooks used in conjunction with knives for forming cut pile tufted fabric.

In the production of tufted pile fabric each reciprocating needle cooperates with a looper or hook which seizes a loop of yarn from the needle and releases the loop to form loop pile fabric or holds the loop until it is cut by a knife acting in scissors-like fashion against the side of the hook to form cut pile fabric. The cutting action occurs as the hook and knife oscillate along different paths, each being retained in a respective support. Conventionally, the knives are mounted in knife blocks including a cylindrical peg extending from the body thereof for insertion within a bore formed in a knife bar as illustrated, for example, in U.S. Pat. No. 3,084,645. Since the knives must act against the face of the respective hooks in scissors-like fashion with sufficient pressure, the knife block is pivoted within the bore to engage the face of the hook at an angle of inclination, generally in the order of approximately 8°, and contact the hook at an angle of canter, generally approximately 4°. The combination of the angle of inclination and the angle of canter provides a compound angle between the knives and the respective hooks. To obtain proper cutting action, the pressure or tension of the knife against the hook must be sufficient to obtain the scissors-type cutting action. To provide the proper tension or loading of the knife against the hook the knife bar is adjusted so that the knife actually flexes or bends due to the loading or forces between the knife and the hook.

However, there are limitations on the loading of the knife since cutting occurs at a location adjacent to the throat of the hook and if contact occurs between the surface of the knife below the cutting edge and the surface of the hook behind the throat, the knife is said to be "heeling" against the hook and cutting either ceases or a very rough cut occurs. Moreover, tension on the knife may be limited in very fine gauge tufting machines, i.e., where the gauge is one-tenth or less since a knife may contact an adjacent hook. In such fine gauge machines a knife relief is often ground into the surface of the hook remote from the cutting surface to prevent or minimize such interference. Consequently, although high knife tension is desirable it is difficult to attain with conventional hooks. In such fine gauge machines the thickness of the yarns that may be cut is limited because of the limitations on the tension that can be applied between the knives and the hooks either due to the "heeling" affect or the limitations on the hook geometry.

Moreover, since the knives and hooks continuously contact one another hook and knife wear occurs rapidly. Once the cutting edges are worn proper cutting action ceases, resulting in very rough cut yarn ends.

Another problem encountered during cutting in a tufting machine results from the fact that the knives act against one face of the hook, and since the hook has a thickness, the leg of the yarn cut against the cutting surface of the hook is shorter than the other leg by an amount substantially equal to the thickness of the hook. Thus, the pile fabric produced has unequal length ends projecting from the backing material and requires substantial tip shearing.

SUMMARY OF THE INVENTION

Consequently, it is a primary object of the present invention to provide a hook for a tufting machine which permits the application of greater tension between the hook and a knife cooperating therewith to cut loops of yarn.

It is another object of the present invention to provide a hook for cooperating with a knife in a fine gauge tufting machine which permits cutting of thicker yarns and alternatively which permits finer gauge cut pile tufting by permitting the tension between the knife and the hook to be increased relative to conventional systems.

It is a further object of the present invention to provide a tufting machine hook for use with an oscillating tufting knife, the hook having a cam surface against which the knife may ride, the cam surface being such that tension between the knife and hook increases as the respective cutting surfaces approach each other as the hook and knife oscillate in a conventional manner.

It is a still further object of the present invention to provide a tufting machine hook for use with an oscillating tufting knife which permits a higher knife tension to be exerted against the hook and which substantially overcomes the problem of "J" cutting the legs of the cut yarn loops.

Accordingly, the present invention provides a hook for tufting machines wherein the face of the hook adjacent the cutting edge against which the knife is tensioned is provided with a relief in the form of an inclined ramp which acts as a cam surface to direct the knife as the knife oscillates relative to the hook. This cam surface is formed on the face of the hook adjacent to the throat of the hook, the throat being that the edge of the hook where the cutting edge of the hook blade or bill intersects the shank which carries the mounting portion of the hook. The cam surface is ground on the hook at an angle relative to the blade surface which increases the distance between the surface of the knife below the cutting edge and the surface of the hook behind the throat and permits greater tension to be applied between the knife and the hook without resulting in "heeling" of the knife against the hook. Moreover, as the flexed knife rides up the cam surface the distance between these surfaces will actually increase resulting in an increase in tension as the cutting edges approach each other. This construction permits elimination of conventional knife relief on the surface opposite the knife engaging surface and permits use of thicker gauge parts. Thus, larger yarns maybe tufted in existing and finer gauge cut pile products may be tufted.

Another aspect of the present invention is to provide an additional relief on the cutting edge of the hook, which may be a continuation of the cam surface or cut at a slightly different slope so that the cutting edge is substantially between the opposed surfaces of the blade of the hook. In this manner, when cutting occurs, the legs of the cut loop will be substantially equal in length, thereby eliminating the "J" cutting problem which has plagued the tufting industry.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
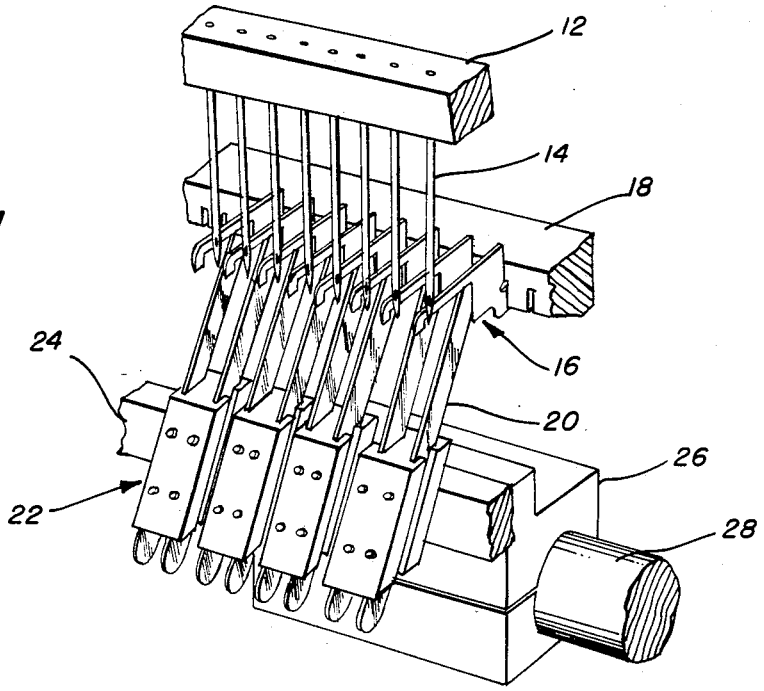
FIG. 1 is a fragmentary perspective view of a portion of a tufting machine illustrating the stitching and cutting instrumentalities and depicting the surface of the hook opposite to the surface against which the knives act.

Referring to the drawings, it is known that tufting machines reciprocably drive a needle bar 12 which carries a multiplicty of needles 14 for cooperating with respective hook 16 mounted in an oscillating hook bar 18, the hooks acting to seize loops of yarn shed by the needles. In cut pile tufting machine, and in machines selectively adapted for forming loop and cut pile selectively by incorporating a spring clip (not illustrated) and which are defined herein to be included within the term "cut pile machines" and the hooks of which are included within the term "cut pile hooks" respective knives 20 cooperate in scissors-like fashion with the hooks 16 to cut all or selected loops, the hook acting as a ledger blade against the cutting edge of the knife. The knives 20 are generally mounted in knife blocks 22 which may be secured to a knife bar 24 which in turn is secured to a knife shaft rocker arm 26 fastened to an oscillating knife shaft 28 to oscillate the knives 20 relative to the hooks 16.

Since cutting action is dependent upon the tension between the knives and the hooks it is conventional that the inclination of the knife blocks 22 and/or the axial disposition of the knife bar 24 may be selectively varied. However, as the tension is increased by, for example, moving the knife bar 24 toward the right as viewed in FIG. 1, and the knives flex, the surface of the knife blade below the cutting edge moves closer to the adjacent surface of the hook and if the knife touches the hook other than at the cutting edge, the knife is said to be "heeling" against the hook and cutting action becomes ineffective. Furthermore, on fine gauge machines, i.e., in the order of one-tenth gauge and less, when the space in between adjacent equivalent gauge parts is one-tenth of an inch and less, the limitation on the minimum thickness on the knives often requires a relief to be ground on the surface of the hook on the side opposite to the knife engaging surface to minimize interference of the knife with the adjacent hook.

Figure 2:
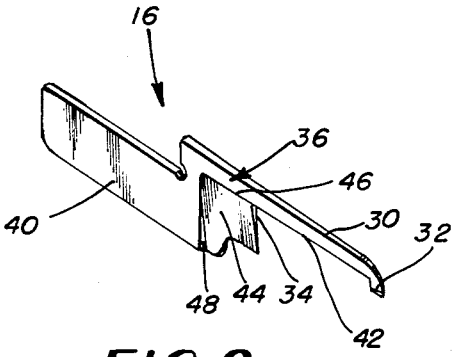
FIG. 2 is a front perspective view of a hook constructed in accordance with the principles of the present invention.

To overcome these problems the present invention provides a hook 16, as illustrated in FIG. 2, which conventionally includes an elongated blade or bill portion 30 having a barb or beak 32 at one end thereof extending from a throat 34 formed at the junction of the blade 30 with a shank 36. The shank 36 includes a free end 40 extending oppositely to the bill 30 to define a mounting portion having opposed planar surfaces for insertion into slots in the hook bar 18 or the like. The underside of the bill 30 adjacent to and extending from the throat 34 has a sharpened bottom edge 42 which conventionally acts as a ledger blade in cooperation with the oscillating knife 20 to cut loops of yarn as they approach the throat. Conventionally, the entire surface of the shank 36, at least on the side on which the knife acts, is coplanar with the mounting portion and with the face of the bill 30. Conventionally, as the surface of the knife oscillates along the shank into and out of cutting engagement of the knife cutting edge with the ledger blade 42 of the hook adjacent the throat 34, the surface of the hook and the surface of the shank become closer. Thus, the amount of tension that can be applied by the knife against the hook is limited. According to the present invention, however, this problem is overcome by grinding the shank 36 adjacent the throat at an inclined or sloped ramp to form a cam surface 44. The upper edge of the cam surface 44 terminates at an edge 46 at the upper surface of the shank which is at the plane of the blade 30, while the lower edge of the cam surface is recessed such as at 48 relative to the remainder of the shank 36 and the mounting portion 40.

The cam surface 44 permits the knife 20 to slide along the incline, which is approximately 6° relative to the remaining surface of the shank, and thereby permits greater tension to be applied between the knife and the hook than in the prior art without resulting in "heeling." In fact the tension between the knife and hook can be set with the knife against a lower portion of the cam surface 44 and as the knife slides up the cam surface tension actually increases as the cutting edges approach each other.

Figure 3:
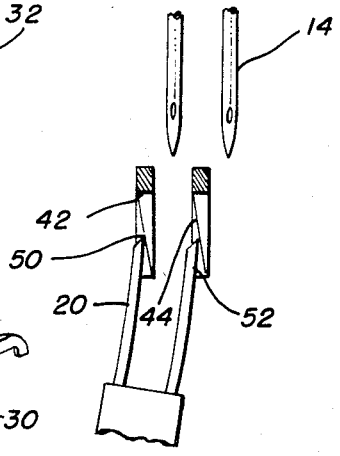
FIG. 3 is a diagrammatic cross sectional view illustrating the action of the knives as they slide up the cam surface of the hook of FIG. 2.
Figure 4:
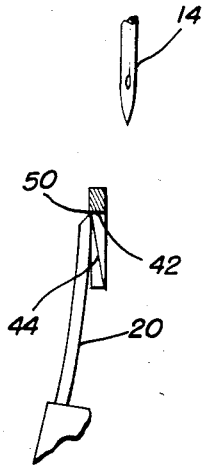
FIG. 4 is a view similar to FIG. 3, but with the cutting edge of the knife disposed further up the cam surface and substantially at the cutting edge of the hook.

Referring to FIGS. 3 and 4 it can be seen that as the cutting edge 50 of the knife 20 moves upwardly toward the edge 42 the tension or pressure between the knife and hook will increase. In the prior art the tension between the knife and hook remain constant. The surface 52 of the knife which rides up the hook remains sufficiently spaced from the cam surface 44. In the prior art the surface 52 approaches the surface of the shank 36 as the tension is increased and thus the tension is limited. With the present invention the tension can be increased, and the gauge parts may be made thicker without interference of a knife with an adjacent hook. Those factors permit larger yarns to be tufted on existing gauges and should permit tufting of finer gauge cut pile fabric.

Figure 5:
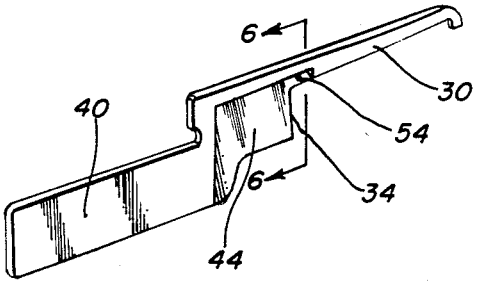
FIG. 5 is a rear perspective view of a hook constructed in accordance with a further aspect of the present invention.
Figure 6:
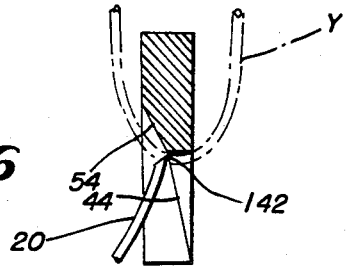
FIG. 6 is a diagrammatic cross sectional view on an enlarged scale illustrating the cutting action of the knife on the hook of FIG. 5 to eliminate "J" cutting.

In accordance with another aspect of the present invention the grinding of the cam surface 44 may be extended forwardly of the throat 34 along the bill 30 at least a portion thereof such as illustrated at the surface 54 in FIGS. 5 and 6, or if preferred, such surface may be extended a greater length along the bill. Preferably this surface 54 is recessed to approximately half the thickness of the hook such that the normal ledger edge 42 of the hook is disposed at an edge 142 substantially equally spaced between the surfaces of the bill adjacent the throat. Consequently, when the knife cuts at the edge 142, the two legs of a yarn Y will be substantially equal in length, thereby to substantially elimininate "J" cutting. The slope of the surface 54 may be the same as that of the surface 44, but as illustrated may be slightly different for particular hooks due to their geometry so as to dispose the edge 142 substantially equally between the surfaces of the bill adjacent the throat.

Numerous alterations of the structure herein disclosed will suggest themselves to those skilled in the art.

However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A cut pile hook for use in a tufting machine, said hook comprising a substantially planar body member of finite thickness having a bill and a shank, said shank including a mounting portion having opposed planar surfaces adapted for mounting in a tufting machine, said bill extending from the shank to define a throat therebetween, a barb extending from said bill remote from said shank, said bill having a top edge and a bottom edge extending from said throat to said barb, said bottom edge being sharpened at one surface of the bill to define a ledger blade, and a cam surface formed in said shank adjacent to said throat, said cam surface extending from adjacent said ledger blade away from said bill, said cam surface defining an inclined ramp extending inwardly away from said top edge intermediate the planar surfaces of said mounting portion, whereby a knife may be tensioned against said ramp and slidably oscillate along the ramp into and out of cutting relationship with said ledger blade.

2. A cut pile hook as recited in claim 1, wherein said ramp comprises a planar surface.

3. A cut pile hook as recited in claim 2, wherein said ramp is inclined approximately 6° relative to the remaining adjacent surfaces of said shank.

4. A cut pile hook as recited in claim 1, including a second ramp extending along said bill adjacent said throat at said ledger blade, said second ramp being inclined inwardly away from said one surface of the bill toward a location substantially equally spaced between said one surface and the opposite surface of said bill.

5. In a cut pile tufting machine including a plurality of hooks adapted to cooperate with respective needles for seizing loops of yarn from said needles, a knife oscillating into cooperative engagement with a respective hook for cutting loops of yarn on said hook, each hook comprising a substantially planar body member of finite thickness having a bill and a shank, said shank including a mounting portion having opposed planar surfaces adapted for mounting in a tufting machine, said bill extending from the shank to define a throat therebetween, a barb extending from said bill remote from said shank, said bill having a top edge and a bottom edge extending from said throat to said barb, said bottom edge being sharpened at one surface of the bill to define a ledger blade, and a cam surface formed in said shank adjacent to said throat, said cam surface extending from adjacent said ledger blade away from said bill, said cam surface defining an inclined ramp extending inwardly away from said top edge intermediate the planar surfaces of said mounting portion, whereby a knife may be tensioned against said ramp and slidably oscillate along the ramp into and out of cutting relationship with said ledger blade.

6. A cut pile hook as recited in claim 5, wherein said ramp comprises a planar surface.

7. A cut pile hook as recited in claim 6, wherein said ramp is inclined approximately 6° relative to the remaining adjacent surfaces of said shank.

8. A cut pile hook as recited in claim 5, including a second ramp extending along said bill adjacent said throat at said ledger blade, said second ramp being inclined inwardly away from said one surface of the bill toward a location substantially equally spaced between said one surface and the opposite surface of said bill.

* * * * *